US006352135B1

(12) United States Patent
Jones

(10) Patent No.: US 6,352,135 B1
(45) Date of Patent: Mar. 5, 2002

(54) ACCESSORY DEVICE FOR LADDERS

(76) Inventor: Myra L. Jones, 554 4th St., Jonesborough, TN (US) 37659

( * ) Notice: Subject to any disclaimer, the term of this patent is extended or adjusted under 35 U.S.C. 154(b) by 0 days.

(21) Appl. No.: 09/571,927

(22) Filed: May 16, 2000

(51) Int. Cl.[7] ..... E04G 1/00

(52) U.S. Cl. ..... 182/129; 182/120; 248/210; 248/238

(58) Field of Search ..... 182/92, 116, 120, 182/121, 122, 129, 214; 248/210, 238, 311.2

(56) References Cited

U.S. PATENT DOCUMENTS

| | | | | | |
|---|---|---|---|---|---|
| 3,814,367 | A | * | 6/1974 | Rasmussen | 248/311 |
| 3,980,264 | A | | 9/1976 | Tomasik | |
| 4,186,903 | A | | 2/1980 | Fazakerley | |
| 4,445,659 | A | | 5/1984 | LaChance | |
| 4,523,733 | A | | 6/1985 | Lauden, Jr. | |
| 4,660,794 | A | * | 4/1987 | Given | 248/238 |
| 4,702,446 | A | | 10/1987 | Brown | |
| 4,949,602 | A | * | 8/1990 | Letts et al. | 81/467 |
| 5,031,723 | A | | 7/1991 | Hooten | |
| D324,272 | S | | 2/1992 | Thiel | |
| 5,135,193 | A | | 8/1992 | Parris | |
| 5,191,954 | A | * | 3/1993 | Ledford | 182/129 |
| 5,316,251 | A | | 5/1994 | McGraw | |
| 5,573,093 | A | * | 11/1996 | Lee | 192/43.2 |
| 5,934,632 | A | * | 8/1999 | Weaver | 248/210 |
| 5,954,157 | A | * | 9/1999 | Grimes et al. | 182/163 |
| 5,960,905 | A | | 10/1999 | Gardner | |
| 5,971,103 | A | * | 10/1999 | Mulvaney | 182/129 |
| 6,076,636 | A | * | 6/2000 | Tietge | 182/129 |

FOREIGN PATENT DOCUMENTS

| | | | | |
|---|---|---|---|---|
| GB | 2310682 | * | 9/1997 | 182/129 X |

* cited by examiner

*Primary Examiner*—Bruce A. Lev
(74) *Attorney, Agent, or Firm*—Dale J. Ream

(57) ABSTRACT

An accessory for installation on a ladder having hollow rungs comprises a holding arm which is shaped to fit within a hollow rung of a ladder. The accessory includes a ratchet assembly mounted within one end of the holding arm. A paint supply holding assembly includes a shaft having an engagement member for engaging the ratchet assembly. As the shaft is rotated in the ratchet assembly, the holding assembly is incrementally pivoted about an axis defined by the shaft. An elongate shaft of a second holding assembly may be inserted into the holding arm from the end opposite the ratchet assembly. The elongate shaft is slidably receivable into an open end of the shaft of the first holding assembly such that a rotation of either shaft causes a simultaneous pivotal movement of both the first and second holding assemblies.

5 Claims, 5 Drawing Sheets

ACCESSORY DEVICE FOR LADDERS

BACKGROUND OF THE INVENTION

This invention relates generally to an accessory for ladders and, more particularly, to an adjustable accessory for holding painting tools and supplies at a level position regardless of the angle of ladder inclination.

Ladders are frequently utilized by painters, carpenters, and other tradesmen to assist in accessing a work area that would otherwise be out of reach. A common problem experienced by such tradesmen, however, is an inability to safely and effectively carry or hold the many tools that may be required to accomplish a particular task while standing on the ladder. For example, a painter may need both a platform for holding paint brushes, scrapers, etc. as well as a holder for a paint bucket.

Various ladder accessories have been proposed in the art. Although assumably effective for their intended purposes, the proposed devices do not provide a means for adjusting the level of the accessory device in a simple and efficient manner. Rather, existing devices require the use of one or both hands to adjust the level of the accessory device.

Therefore, it is desirable to have a ladder accessory device which can be adjusted to a level configuration with only one hand, even while holding an article in that hand. Further, it is desirable to have a ladder accessory device which allows two separate paint supply holding devices positioned on opposite sides of a ladder to be simultaneously adjusted. Finally, it is also desirable to have a ladder accessory device in which at least one holding device is selectively self-leveling.

SUMMARY OF THE INVENTION

An accessory device for installation on a ladder having hollow rungs includes a holding arm shaped to be inserted within a ladder rung having a flat top side to prevent rotation of the holding arm therein. The holding arm is hollow and includes a ratchet assembly mounted within one end thereof, the ratchet assembly having a rotatively mounted coupling structure therein.

The ladder accessory includes a pair of devices for holding paint supplies. A first holding device is a paint can holder having at least a pair of U-shaped brackets depending from a support band. The brackets extend across the diameter of the support band and are spaced apart for supporting a paint can or pail thereon. A shaft extends from the support band and includes an engagement member at a free end thereof. The engagement member presents a hexagonal configuration complementary to that of the ratchet assembly coupling structure for removable engagement therewith. An operation of the shaft within the rotative coupling structure causes an incremental rotation or pivotal movement of said shaft and first holding device. Use of the ratchet assembly allows the shaft to be incrementally rotated therein by grasping and turning the shaft or merely by nudging the holding device itself, such as with the back of a hand that is holding a tool.

A second holding device is an accessory tray having a base which integrally defines a plurality of containers for holding selected accessories therein. The accessory tray includes a side wall extending vertically from the base with an elongate shaft extending outwardly therefrom. The shaft is configured for insertion within the holding arm, preferably through an end opposite the end housing the ratchet assembly. The shaft includes a free end presenting a hexagonal configuration for mating with an open free end of the shaft of the first holding device when the shafts of both devices are inserted within the holding arm. The elongate shaft of the second holding device also includes a hexagonal engagement member intermediate the free end and the side wall of the accessory tray. The engagement member is configured to engage the coupling structure of the ratchet assembly if the second holding device is inserted into the holding arm from the ratchet assembly end.

The ratchet assembly includes a four-position switch for selectively changing the direction with which an operation of the ratchet assembly rotates a shaft coupled thereto. A particular switch setting also allows the shaft coupled to the ratchet assembly to rotate freely therein so that the holding device will level itself through gravitational forces, i.e. from the weight of the paint can. Another switch setting locks the ratchet assembly to preclude movement of the shaft therein.

Therefore, it is a general object of this invention to provide a ladder accessory for installation on a ladder having hollow rungs.

Another object of this invention is to provide a ladder accessory, as aforesaid, which can selectively keep a paint supply holding device in a level configuration regardless of the level of incline of the ladder.

Still another object of this invention is to provide a ladder accessory, as aforesaid, which includes a holding arm configured for insertion within a hollow rung having a flat top side for precluding rotation of the holding arm therein.

Yet another object of this invention is to provide a ladder accessory, as aforesaid, having a ratchet assembly for incrementally pivoting a holding device coupled thereto.

A further object of this invention is to provide a ladder accessory, as aforesaid, in which various holding devices may be releasably coupled to the ratchet assembly.

A still further object of this invention is to provide a ladder accessory, as aforesaid, in which multiple holding devices may be releasably coupled to one another within the holding arm.

A particular object of this invention is to provide a ladder accessory, as aforesaid, in which the ratchet assembly can selectively preclude movement of a shaft therein, allow a shaft therein to move freely, or allow a shaft therein to move incrementally in a clockwise or counterclockwise direction.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
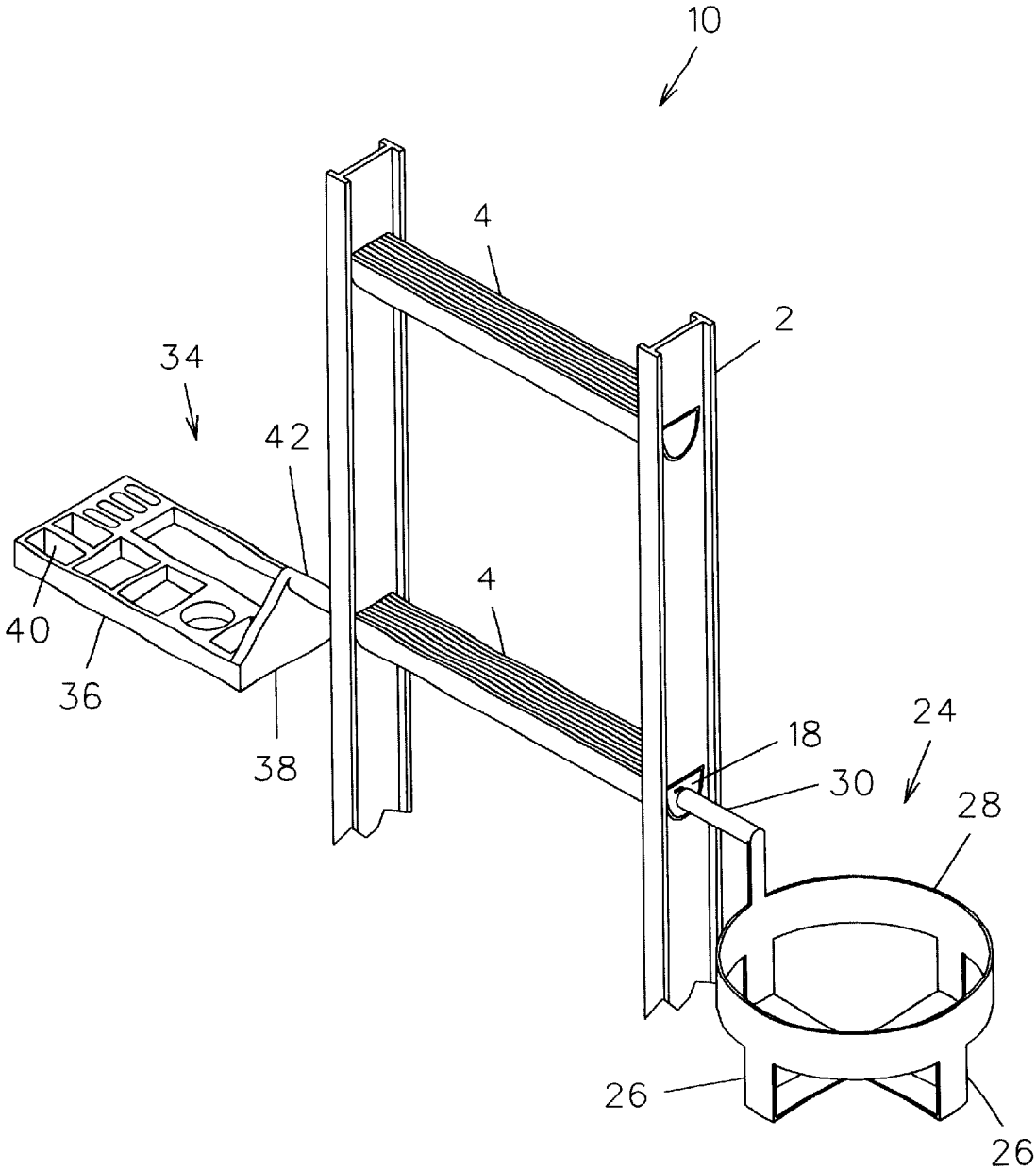
FIG. 1 is a perspective view of the ladder accessory device installed on a ladder according to the preferred embodiment of the present invention.

The preferred embodiment of the accessory device 10 for ladders will now be described with reference to FIGS. 1–4 of the accompanying drawings. The accessory device 10 includes a holding arm 12 having a flat top side 14 suitable for installation on a ladder 2 having hollow rungs 4, each rung defining a flat top (FIG. 3). The holding arm 12 may be inserted into a selected rung 4, the flat top side configurations precluding rotation of the holding arm 12 therein.

The holding arm 12 is hollow and thus defines a passage therethrough. The holding arm 12 includes a ratchet assembly 18 mounted therein adjacent a first end 16 thereof (FIG. 3). The ratchet assembly 18 includes a side wall defining an opening in communication with a coupling structure 20 rotatively mounted therein in operative contact with bearings for pivotal movement thereof. Preferably, the opening and coupling structure 20 present hexagonal configurations although a ratchet assembly presenting another configuration would also be suitable. The ratchet assembly 18 further includes a four position switch 22 mounted to the side wall above the opening. As to be discussed more fully below, respective switch settings allow the coupling structure 20 to rotate freely through the use of surrounding bearings, to preclude movement thereof, or to incrementally rotate in a clockwise or counterclockwise direction. The ratchet assembly 18 of the present invention is of the type in which the shaft only moves in the selected direction and does not free float in a reverse direction between incremental movements.

The ladder accessory 10 includes a pair of devices for holding paint supplies. A first holding device 24 is a paint can or pail holder having at least a pair of U-shaped brackets 26 depending from a main support band 28. Each bracket 26 includes a pair of diametrically opposed upright segments integrally attached to the support band 28 and extending downwardly therefrom. A horizontal segment extends between lower ends of each upright segment. Horizontal segments of the two brackets intersect at right angles to provide a secure holding member for a paint can. A tubular shaft 30 extends outwardly from the support band 28 and includes an engagement member 32 at an open free end 33 thereof The engagement member 32 presents a hexagonal configuration complementary to that of the ratchet assembly 18 opening and coupling structure 20 such that the engagement member 32 may be inserted therein. It is understood that the engagement member 32 may also include a nub (not shown) for snappably engaging the ratchet assembly 18 in a manner known in the art. When the switch is set appropriately, an operation of the shaft 30 within the ratchet assembly coupling structure 20 causes an incremental rotation or pivotal movement of said shaft 30 and first holding device 24. It should be appreciated that the incremental nature of this movement enables a user to adjust the level of the first holding device 24 by grasping and rotating the shaft or merely by firmly nudging the first holding device 24 in the desired direction with the arm or back of the hand.

Figure 2:
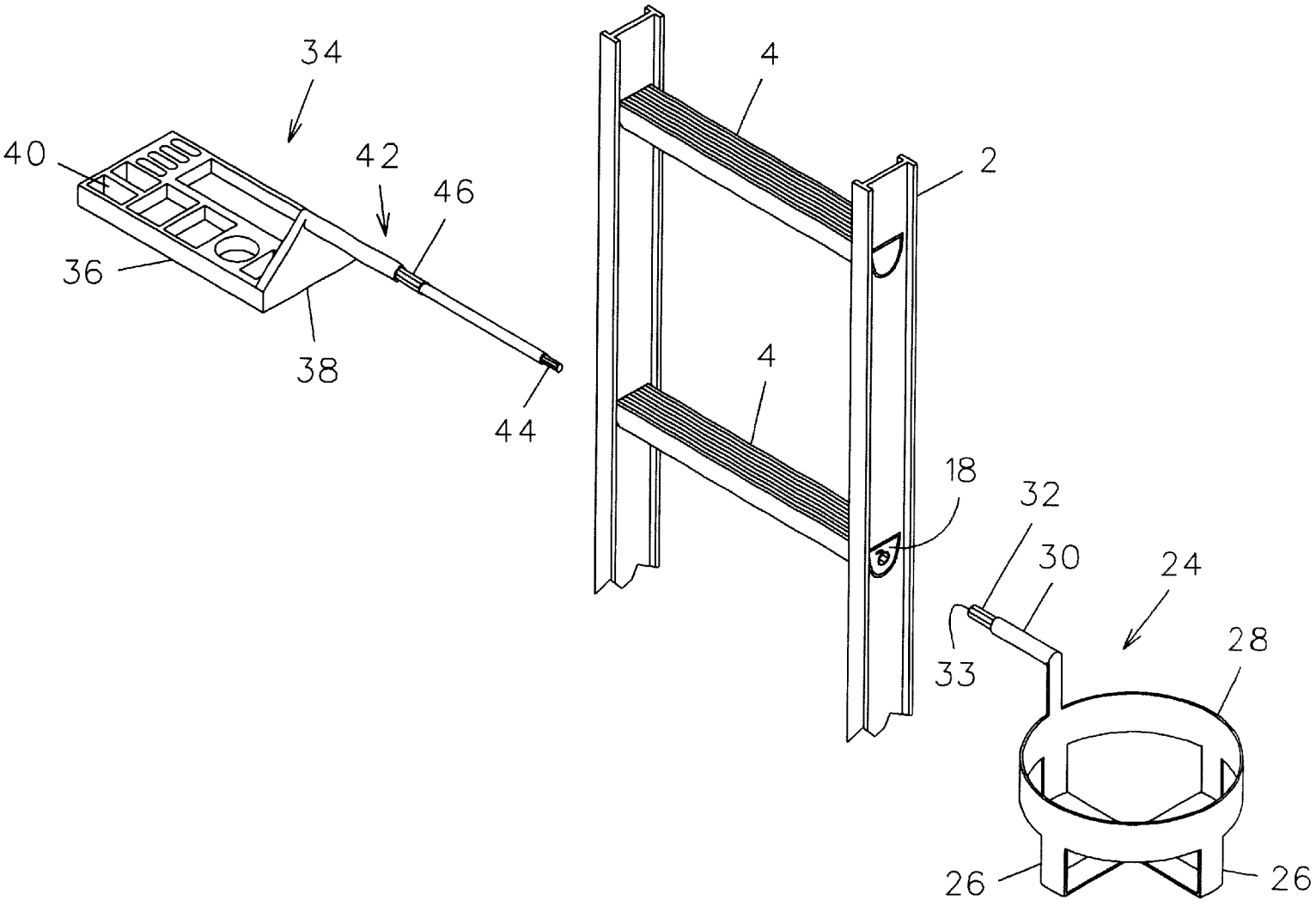
FIG. 2 is a perspective view of the accessory device as in FIG. 1 with the paint supply holding devices removed from engagement therewith.
Figure 3:
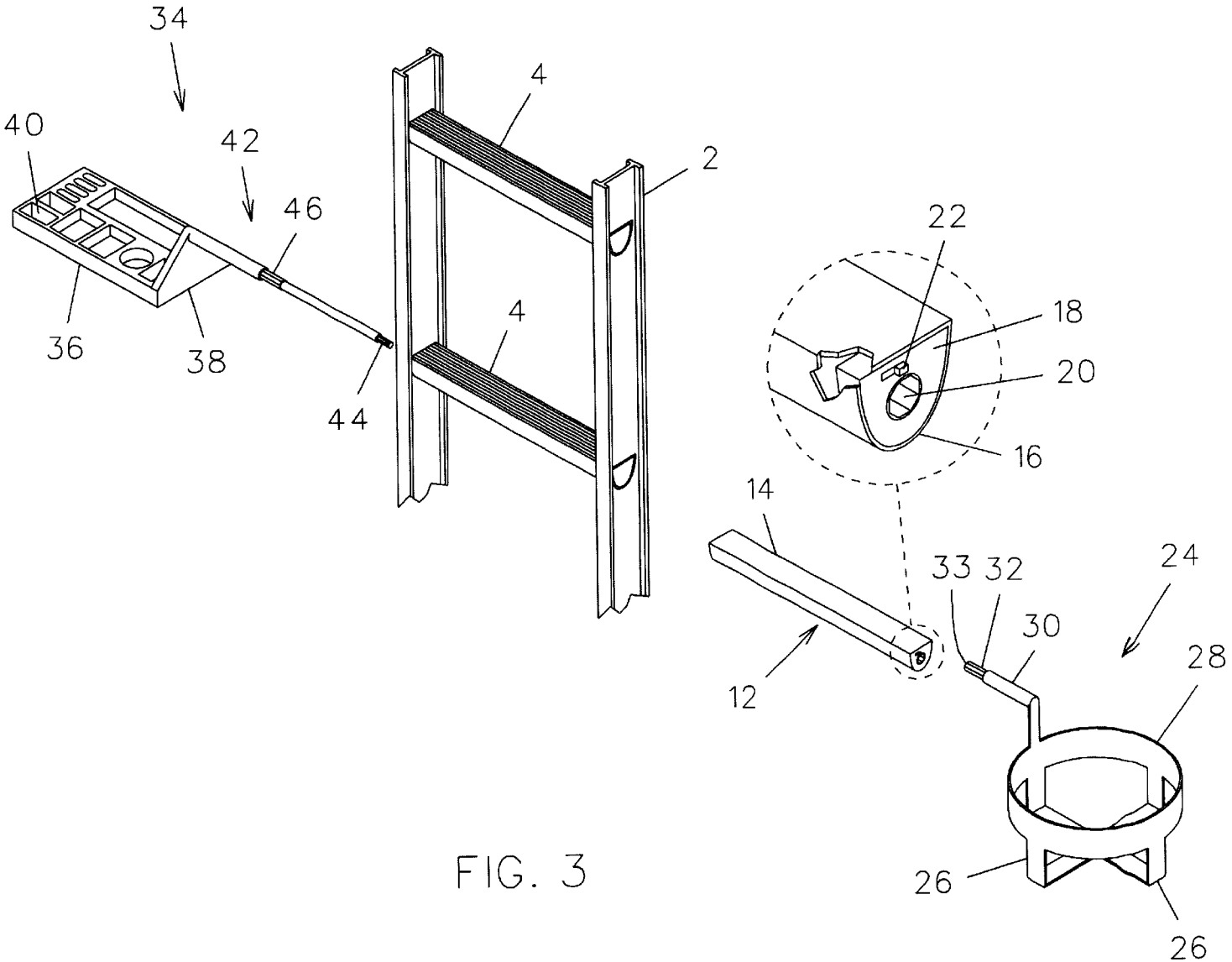
FIG. 3 is a perspective view of the accessory device as in FIG. 2 with the holding arm removed from the ladder and with an isolated view on an enlarged scale of the ratchet assembly.
Figure 4:
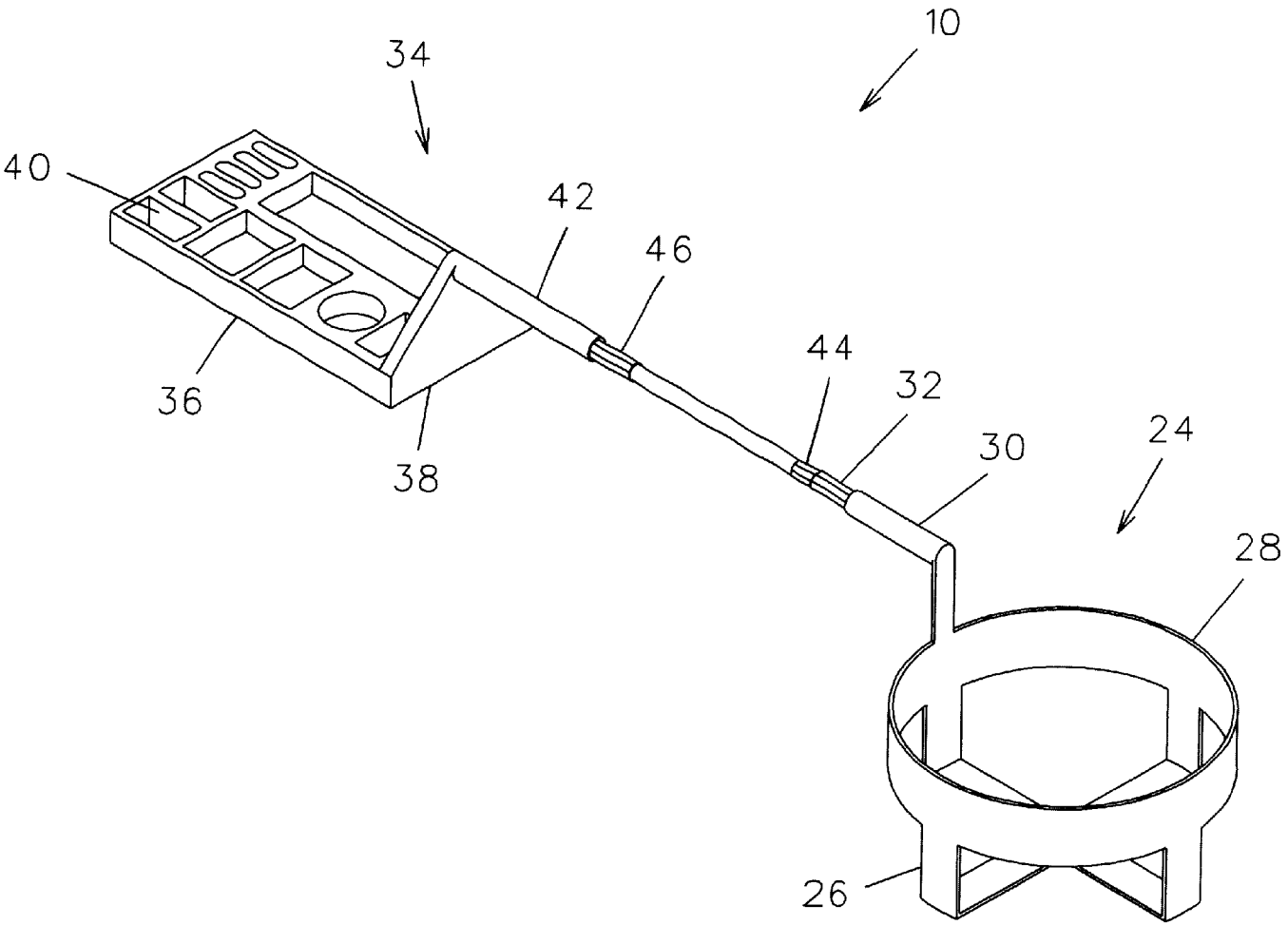
FIG. 4 is a perspective view of the accessory device as in FIG. 1 with the ladder and holding arm removed.

The ladder accessory device 10 further includes a second holding device 34 in the form of an accessory tray having a base 36 which integrally defines a plurality of containers 40 for holding a plurality of selected supplies (FIG. 2). The second holding device 34 includes an upstanding side wall 38 mounted atop the base 36. An elongate shaft 42 extends outwardly from the Bide wall 38 and includes a free end 44 and an engagement member 46 intermediate the side wall 38 and the free end 44. While both the engagement member 46 and the free end 44 include hexagonal configurations, the engagement member 46 presents a diameter complementary to the diameter of the ratchet assembly coupling structure 20. Therefore, the shaft 42 of the second holding device 34 may be inserted into the ratchet assembly 18 in place of the first holding device 24 with the engagement member 46 engaging the ratchet assembly 18 for operation as previously described.

Preferably, however, the elongate shaft 42 is shaped for insertion within the holding arm 12 through the second end thereof, or, more particularly, through the end opposite the ratchet assembly 18. The free end 44 of the elongate shaft 42 of the second holding device 34 has a diameter slightly smaller than a diameter of the open free end 33 of the shaft 30 of the first holding device. Therefore, the free end 44 of the second holding device shaft 42 is slidably received within the open free end 33 of the first holding device shaft 30 when both holding devices are inserted within the holding arm 12. Accordingly, a rotation of one shaft simultaneously causes a corresponding rotation of the other.

In operation, the holding arm 12 is slidably inserted into a desired rung of a ladder 2 having hollow rungs. The flat top side configuration of the rungs and holding arm 12 precludes rotation of the holding arm 12 therein. The first 24 and second 34 holding devices may then be coupled to the holding arm 12 as desired. If only the second holding device 34 (i.e., the accessory tray) is needed, it may be attached by inserting the elongate shaft 42 through the ratchet assembly coupling structure 20 until the engagement member 46 mates therewith. However, if the first holding device (i.e. the pail holder) is needed, the free end 33 of the first holding device shaft 30 is inserted into the ratchet assembly coupling structure 20. If both holding devices are needed, the elongate shaft 42 of the second holding device 34 is inserted within the holding arm 12 through the end opposite the ratchet assembly 18 until the free end 44 thereof is received within the open free end 33 of the first holding device shaft 30.

To initially set the holding devices to a level position relative to the ground, a user manipulates the switch 22 on the ratchet assembly 18. One switch setting allows the coupling structure 20 to rotate freely to allow the holding devices to level themselves through gravitational forces or to allow a user to pivot the holding devices to a desired configuration. Another switch setting locks the ratchet assembly 18 to preclude further movement of the coupling structure 20. The other two switch settings cause the bore to incrementally rotate in a clockwise or counterclockwise direction in a typical ratchet manner.

Figure 5:
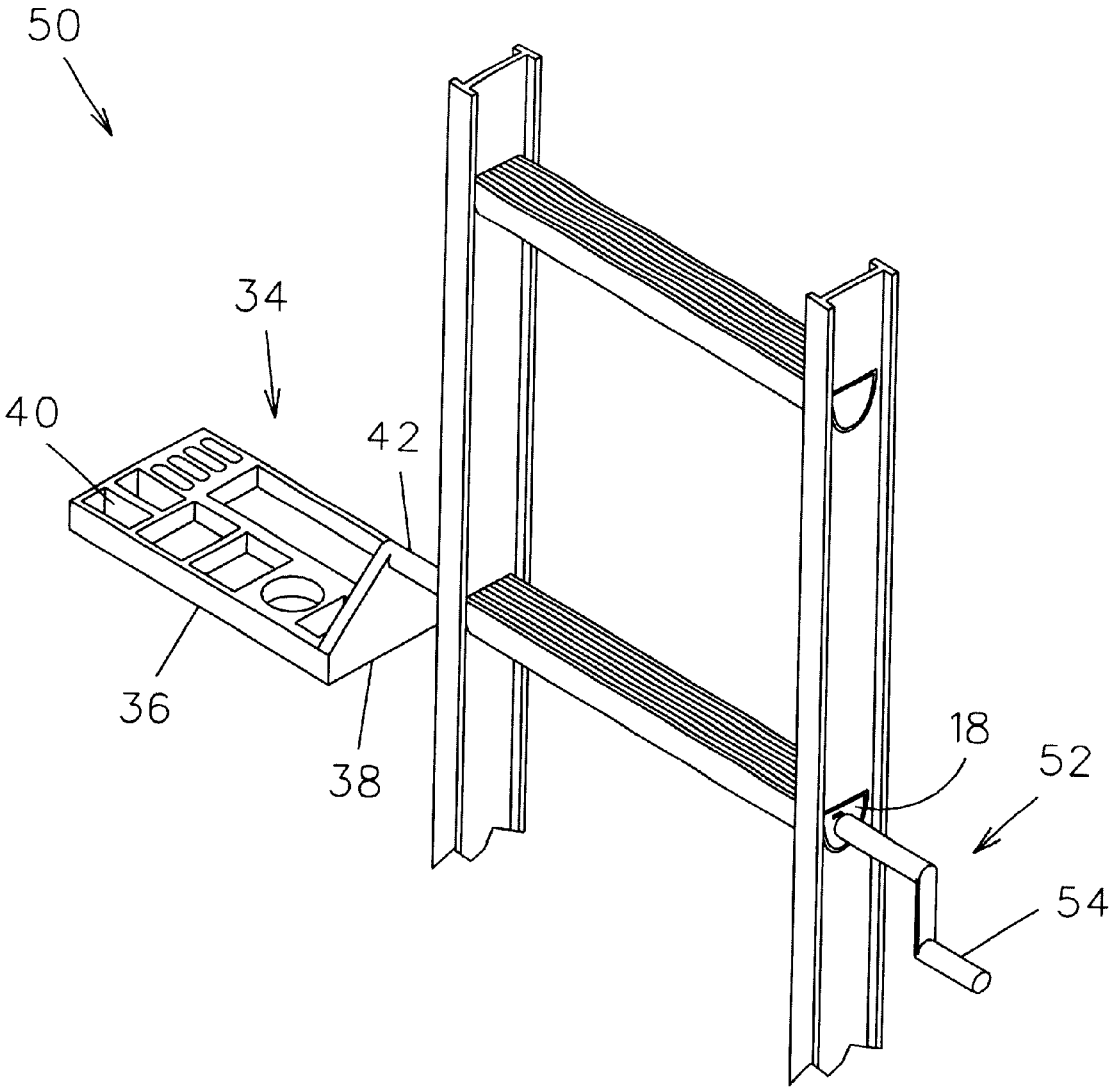
FIG. 5 is a perspective view of an alternative embodiment of the accessory device.

An alternative embodiment 50 of the ladder accessory device is shown in FIG. 5 and is substantially similar to the preferred embodiment described above except as specifically noted below. In the alternative embodiment 50, a handle assembly 52 replaces the first holding device. The handle assembly 52 includes a handle 54 at one end and an engagement member (not shown) at an opposed end. The engagement member includes a hexagonal configuration for releasable engagement with the ratchet assembly 18. The engagement member also defines an open end for receiving the slightly smaller free end of the second holding device shaft 42 as described above and shown in FIG. 4. Therefore, assuming an appropriate switch setting has been selected, an operation of the handle assembly 52 causes an incremental rotation of the shaft 42 for leveling the second holding device 34 as desired.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An accessory device for installation on a ladder having hollow rungs extending through a pair of spaced apart rails, comprising:

a holding arm configured for insertion within a hollow rung of a ladder, said holding arm defining a passage therethrough;

a ratchet assembly disposed in one end of said holding arm;

a first holding device for holding painting supplies having a shaft extending therefrom, said shaft including an open end and an engagement member configured to removably engage said ratchet assembly, whereby an operation of said shaft causes an incremental movement of said first holding device; and a second holding device including an accessory tray having a base and at least one side wall extending upwardly from said base, said second holding device having an elongate shaft extending from said at least one side wall adapted to be selectively inserted into said holding arm through said ratchet assembly at said one end or through an end of said holding arm opposite said ratchet assembly, said elongate shaft having a free end dimensioned for insertion into said open end of said shaft of said first holding device when said elongate shaft is inserted into said holding arm through said end opposite said ratchet assembly such that a movement of either said shaft or said elongate shaft causes a simultaneous movement of said first and second holding devices, said elongate shaft having an engagement member intermediate said free end and said at least one side wall adapted to engage said ratchet assembly when said shaft of said first holding device is removed from said one end of said holding arm and said elongate shaft is inserted into said holding arm through said one end such that a movement of said elongate shaft causes a movement of said second holding device.

2. An accessory device as in claim 1 wherein said first holding device is a pail holder having at least a pair of U-shaped support brackets depending from a support band and being normal to one another, each support bracket extending between opposite sides of said band;

wherein said base of said accessory tray defines a plurality of containers for holding selected accessories therein.

3. An accessory device as in claim 1 wherein a portion of said passage through said holding arm defines a hexagonal configuration;

a portion of said shaft of said first holding device defines a hexagonal configuration adapted to selectively mate with said hexagonal portion of said passage;

a portion of said shaft of said second holding device defines a hexagonal configuration adapted to selectively mate with said hexagonal portion of said passage; and said accessory device further comprising means for selectively allowing said first and second shafts to rotate incrementally within said passage.

4. An accessory device as in claim 1 wherein said holding arm further comprises a top side adapted to be positioned adjacent a top side of a respective hollow rung upon said holding arm insertion through the respective hollow rung, said top side of said holding arm adapted to preclude rotation of said holding arm within the respective rung.

5. An accessory device as in claim 1 wherein said ratchet assembly includes:

means for selectively switching the direction of incremental movement imparted to said first holding device upon an operation of said shaft; and means for selectively allowing said shaft of said first holding device to pivot freely within said ratchet assembly such that said first holding device is gravitationally moved to a level configuration.

* * * * *